US011035360B2

(12) United States Patent
Wang et al.

(10) Patent No.: US 11,035,360 B2
(45) Date of Patent: Jun. 15, 2021

(54) GEROTOR WITH SPINDLE

(71) Applicant: Stackpole International Engineered Products, Ltd., Ancaster (CA)

(72) Inventors: Liping Wang, Toronto (CA); Richard Muizelaar, Mississauga (CA); Andrzej Kowalski, Toronto (CA); Vladimir Vukas, Ancaster (CA)

(73) Assignee: Stackpole International Engineered Products, Ltd., Ancaster (CA)

( * ) Notice: Subject to any disclaimer, the term of this patent is extended or adjusted under 35 U.S.C. 154(b) by 161 days.

(21) Appl. No.: 16/274,676

(22) Filed: Feb. 13, 2019

(65) Prior Publication Data

US 2019/0249661 A1 Aug. 15, 2019

Related U.S. Application Data

(60) Provisional application No. 62/630,523, filed on Feb. 14, 2018.

(51) Int. Cl.
*F04C 2/10* (2006.01)
*F04C 2/08* (2006.01)
(Continued)

(52) U.S. Cl.
CPC ..... *F04C 2/102* (2013.01); *F04C 2/084* (2013.01)

(58) Field of Classification Search
CPC .. F04C 2/102; F04C 2/084; F04C 2/10; F04C 11/08; F04C 15/0069; F01C 21/10
See application file for complete search history.

(56) References Cited

U.S. PATENT DOCUMENTS 1,486,836 A 3/1924 Hill
1,497,050 A 6/1924 Wardwell
(Continued)

FOREIGN PATENT DOCUMENTS

EP 1566545 A2 8/2005
WO 2010/051640 A1 5/2010
WO 2014/014943 A1 1/2014

OTHER PUBLICATIONS

International Preliminary Report on Patentability dated May 12, 2020 issued in corresponding International Application No. PCT/IB2019/051171 (11 pages).
(Continued)

*Primary Examiner* — Deming Wan
(74) *Attorney, Agent, or Firm* — Pillsbury Winthrop Shaw Pittman, LLP

(57) ABSTRACT

Disclosed is a gerotor pump including an inner gear mounted on a first axis, an outer gear mounted on a second axis and meshing internally with the inner gear in an offset manner, and an electrical motor including a rotor and a stator having a radial gap therebetween in a radial direction. The pump also includes a spindle fixedly coupled to the outer gear to facilitate maintaining the radial gap. The spindle is rotatably coupled for rotation about the second axis. The spindle aids in maintaining a consistent radial gap during operation of the gerotor pump. The inner gear may be coupled to a drive shaft for driving the gears. The gerotor pump may be driven via an electric or mechanical driver. A pressure plate may also be positioned adjacent the gerotor gears and within the housing. The spindle and pressure plate help secure the pump parts both axially and radially.

19 Claims, 10 Drawing Sheets

(51) Int. Cl.
*F04C 15/00* (2006.01)
*F01C 21/10* (2006.01)

(56) References Cited

U.S. PATENT DOCUMENTS

| | | | |
|---|---|---|---|
| 1,501,051 | A | 7/1924 | Hill |
| 1,513,659 | A | 10/1924 | Wardwell |
| 1,531,591 | A | 11/1924 | Edwards |
| 1,631,591 | A | 6/1927 | Hill |
| 1,990,750 | A | 2/1935 | Pigott |
| 3,034,446 | A | 5/1962 | Brundage |
| 3,034,447 | A | 5/1962 | Brundage |
| 3,034,448 | A | 5/1962 | Brundage |
| 4,715,798 | A | 12/1987 | Bernstrom |
| 5,145,329 | A | 9/1992 | Zumbusch et al. |
| 5,219,276 | A | 6/1993 | Metzner et al. |
| 5,360,322 | A | 11/1994 | Henein et al. |
| 5,704,863 | A | 1/1998 | Zalewski et al. |
| 6,106,240 | A | 8/2000 | Fischer et al. |
| 6,578,654 | B2 | 6/2003 | Porter |
| 6,672,420 | B2 | 1/2004 | Porter |
| 6,688,851 | B2 | 2/2004 | Phelan et al. |
| 6,932,587 | B2 | 8/2005 | Dong |
| 6,942,055 | B2 | 9/2005 | Forsyth et al. |
| 6,966,396 | B2 | 11/2005 | Forsyth et al. |
| 7,070,402 | B2 | 7/2006 | Al et al. |
| 7,158,623 | B1 | 1/2007 | Sakakibara et al. |
| 7,175,013 | B2 | 2/2007 | Burns et al. |
| 7,261,195 | B2 | 8/2007 | Burns et al. |
| 7,314,352 | B2 | 1/2008 | Nakaysohi et al. |
| 7,520,732 | B2 | 4/2009 | Agner et al. |
| 7,695,260 | B2 | 4/2010 | Holtzapple et al. |
| 8,491,288 | B2 | 7/2013 | Lyons et al. |
| 8,696,326 | B2 | 4/2014 | Hadar et al. |
| 8,714,951 | B2 | 5/2014 | Yarr |
| 8,753,099 | B2 | 6/2014 | Holtzapple et al. |
| 8,905,735 | B2 | 12/2014 | Holtzapple et al. |
| 9,163,628 | B2 | 10/2015 | Duncan et al. |
| 9,309,885 | B2 | 4/2016 | Blechschmidt |
| 9,358,967 | B2 | 6/2016 | Uchiyama et al. |
| 9,670,924 | B2 | 6/2017 | Holtzapple et al. |
| 2003/0209399 | A1* | 11/2003 | Organek ..... F16D 27/115 192/35 |
| 2005/0063851 | A1 | 3/2005 | Phillips |
| 2005/0186089 | A1 | 8/2005 | Nakayoshi |
| 2006/0039815 | A1 | 2/2006 | Chertok et al. |
| 2006/0140810 | A1* | 6/2006 | Kameya ..... F04C 15/0034 418/61.3 |
| 2010/0130327 | A1 | 5/2010 | Morgan, Jr. |
| 2010/0290934 | A1* | 11/2010 | Hadar ..... F04C 2/102 417/410.4 |
| 2011/0129364 | A1* | 6/2011 | Yamamori ..... F04C 2/086 417/363 |
| 2013/0150199 | A1* | 6/2013 | Riegert ..... F16H 37/065 475/5 |
| 2016/0298624 | A1 | 10/2016 | Sakai et al. |
| 2016/0298625 | A1 | 10/2016 | Sakai et al. |
| 2016/0305425 | A1 | 10/2016 | Sakai et al. |
| 2017/0284391 | A1 | 10/2017 | Klippert et al. |
| 2017/0298941 | A1 | 10/2017 | Irie et al. |

OTHER PUBLICATIONS

Written Opinion of the International Searching Authority dated May 23, 2019 issued in corresponding International Patent Application No. PCT/IB2019/051171.

Extended European Search Report dated Apr. 6, 2021, issued in corresponding European Patent Application No. 19753942.2 (8 pgs.).

* cited by examiner

Section A—A

Section A—A

Section B—B

GEROTOR WITH SPINDLE

CROSS REFERENCE TO RELATED APPLICATION

This patent application claims priority to provisional patent application 62/630,523 filed on Feb. 14, 2018, whose subject matter is hereby incorporated by reference herein in its entirety.

BACKGROUND

Field

This disclosure relates generally to a gerotor pump. More particularly, the present disclosure relates to a gerotor pump having a spindle coupled to a gear arrangement of the gerotor.

Description of the Related Art

A gerotor pump may be used as a positive displacement pump. Typically, a gerotor includes an inner gear (or rotor) that meshes with an outer gear (rotor). The outer gear has greater number of teeth than the inner gear. The axis of the inner gear is offset from the axis of the outer gear and both gears rotate on their respective axes. The offset creates a changing-volume space between them. During a rotation cycle, fluid may enter a suction side of the gerotor, get pressurized due to the changing-volume space and the pressurized fluid is discharged at a discharge port of the gerotor. Such gerotors can experience several mechanical and frictional losses, and may be bulky.

SUMMARY

An aspect of this disclosure provides a gerotor pump that includes an inner gear mounted on a first axis for rotation, an outer gear relative to a second axis and meshing internally with the inner gear in an offset manner, a drive shaft coupled to the internal gear to drive the internal gear about the first axis in order to pressurize the received fluid for output as the pressurized fluid, and an electrical motor including a rotor and a stator having a radial gap therebetween in a radial direction. The rotor is disposed on an outer surface of the outer gear. The gerotor pump also includes a spindle that is fixedly coupled to the outer gear to facilitate maintaining the radial gap between the rotor and the stator in the radial direction. The spindle is also configured for rotation about the second axis.

Another aspect of this disclosure includes a system having the above-noted gerotor pump along with an engine or transmission.

Other aspects and features of the disclosure will become apparent from the following detailed description, the accompanying drawings, and the appended claims.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments. Further, it is intended that embodiments of the disclosed subject matter cover modifications and variations thereof.

It is to be understood that terms such as "top," "bottom," "side," "height," "upper," "lower," "interior," "exterior,"

"inner," "outer," and the like that may be used herein merely describe points of reference and do not necessarily limit embodiments of the present disclosure to any particular orientation or configuration. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation, or any requirement that each number must be included.

Also, the terms "fluid" and "lubricant" are used interchangeably throughout this disclosure and not intended to limit this disclosure in any way. In some embodiments, fluid or lubricant may refer to oil, e.g., such as engine oil. In other embodiments, fluid or lubricant may refer to transmission fluid.

Figure 1A:
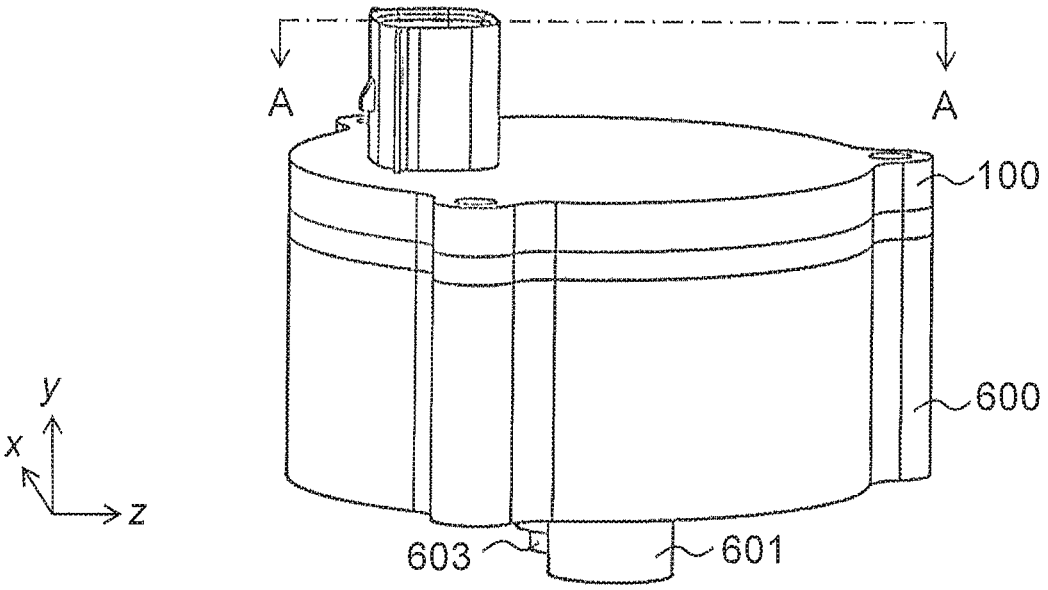
FIG. 1A is a first perspective view of a gerotor pump in accordance with an embodiment of this disclosure.
Figure 1B:
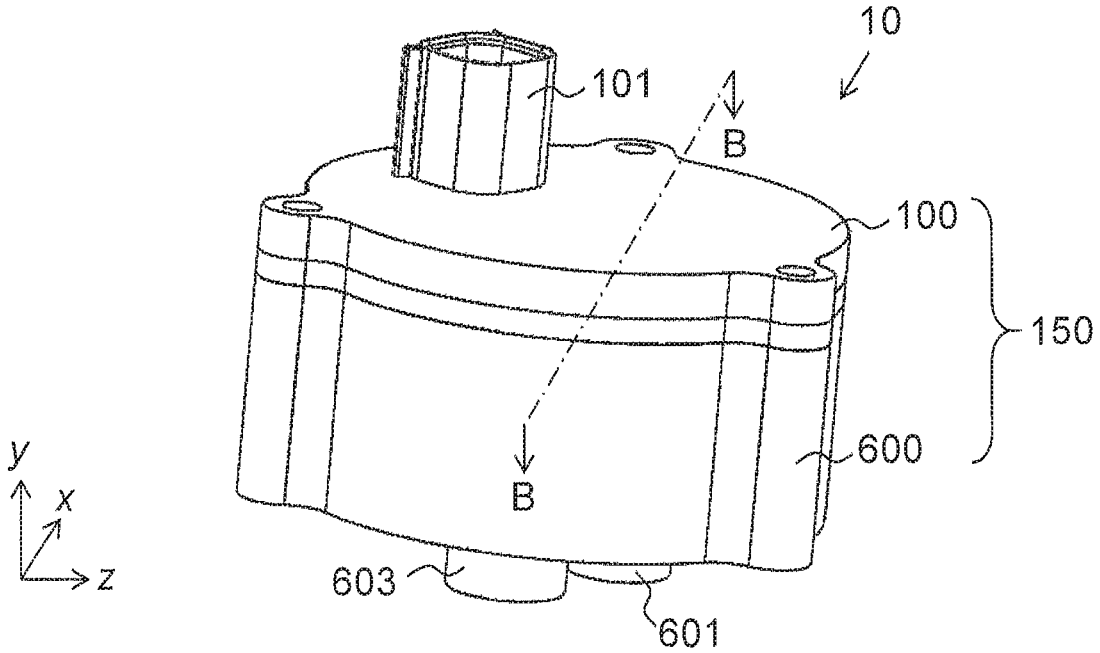
FIG. 1B is a second perspective view of the gerotor pump in accordance with an embodiment of this disclosure.

FIGS. 1A and 1B illustrate different perspective views of a gerotor pump 10 in accordance with an embodiment. The gerotor pump 10 includes a top cover 100 mounted to a bottom casing 600 to form a housing assembly 150 (also referred as a housing 150 or a gerotor housing 150 herein). The gerotor pump 10 also includes a set 400 of gerotor gears (e.g., an inner gear 401 and an outer gear 402 shown in FIG. 3A) enclosed in the housing 150. The bottom casing 600 includes an input (or entry) port 601 through which fluid (e.g., oil or lubricant) may enter from a source and into the housing assembly 150, and a discharge or outlet port 603 through which pressurized fluid may exit for delivery to a system. In operation, the gerotor gears 400 create suction at an input port 601 causing a fluid to enter the housing assembly 150, and the gerotor gears compress or pressurize the fluid as they rotate, and discharge or output the pressurized fluid through the discharge or outlet port 603. The pump outlet port 603 is used for discharging or delivering the pressurized fluid or lubricant to a system such as a transmission or engine, for example.

In an embodiment, the gerotor pump 10 may be electrically driven or mechanically driven. For example, the electrically driven gerotor pump may include a set of electric coils configured to rotate one of the gerotor gears (e.g., the outer gear 402). The electrical power supply may be provided through electrical wires passed through a spout 101 of the top cover 100. Hereinafter, the discussion includes electrical drive to illustrate the concepts and working of the gerotor pump 10 and does not limit the scope of the present disclosure. The gerotor pump 10 may be modified to include mechanical drive as can be understood by a person skilled in the art. For example, in case of mechanically driven gerotor, an input shaft (not shown) may be coupled to one of the gerotor gear (e.g., the inner gear 401) through the bottom casing 600 of the housing to drive the gerotor pump 10.

Figure 2:
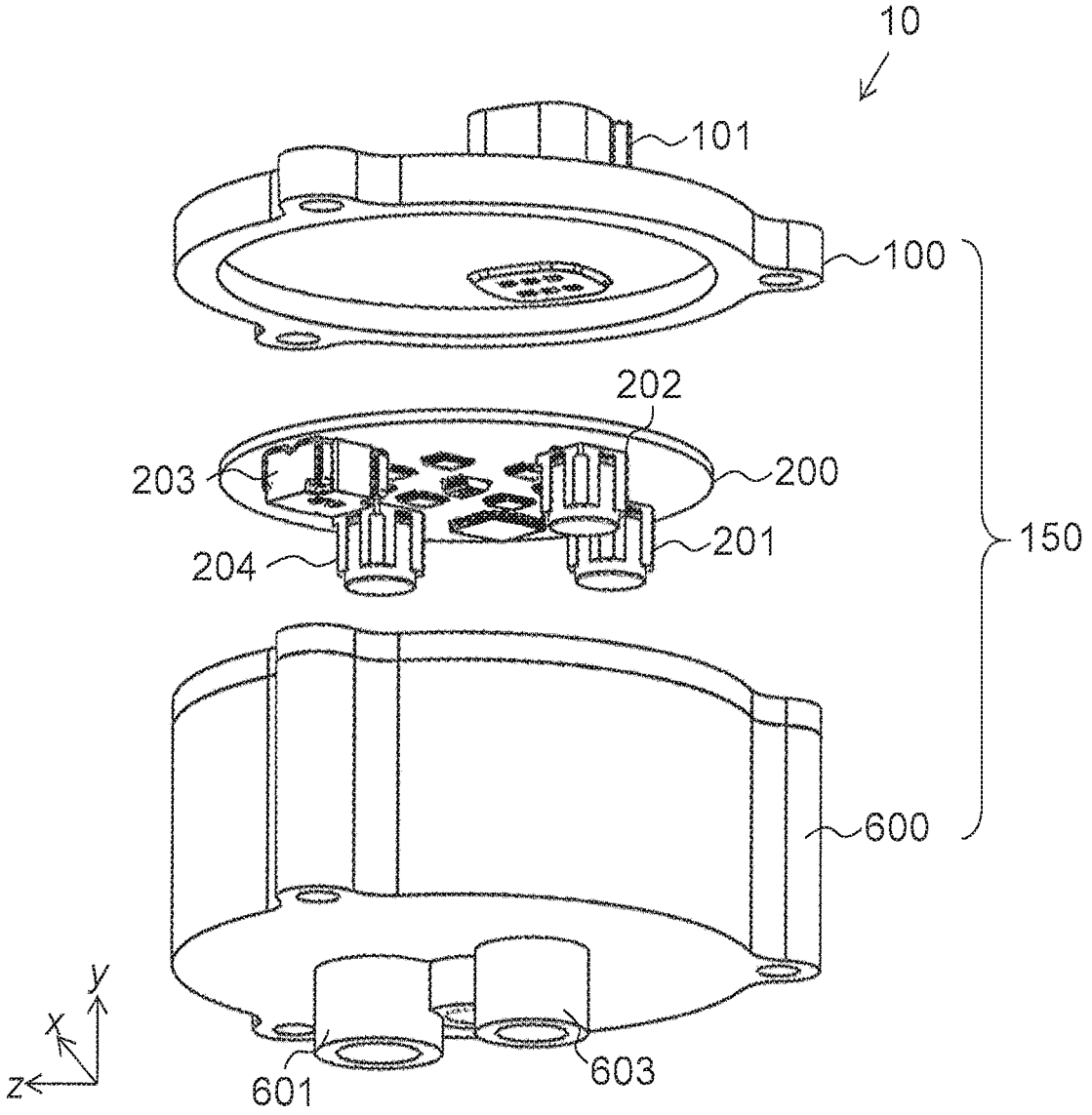
FIG. 2 is an exploded view of the gerotor pump in accordance with an embodiment of this disclosure.

FIG. 2 is an exploded view of the gerotor pump 10 illustrating a controller having an electric circuit board 200 that may be part of the electrically driven gerotor pump 10. The electric circuit board 200 may receive power or other communication/control signals through the electric wires passed through the spout 101. The electric circuit board may include several electrical components such as resistors, capacitors (e.g., 201, 202, 204), power circuit 203, and/or other electrical components configured to control, for example, current and voltage, to operate the gerotor pump 10. In an embodiment, the electrical circuit board 200 may be configured to control current or voltage through electric coils (discussed below) that create magnetic field which may be used to drive a gear (e.g. the outer gear 402) of the gerotor. The electric circuit board 200 may be referred to herein as printed circuit board (PCB), or a controller, as may be understood by a person skilled in the art. The PCB 200 or controller may be provided in the form of a bus bar, in accordance with an embodiment.

Figure 3A:
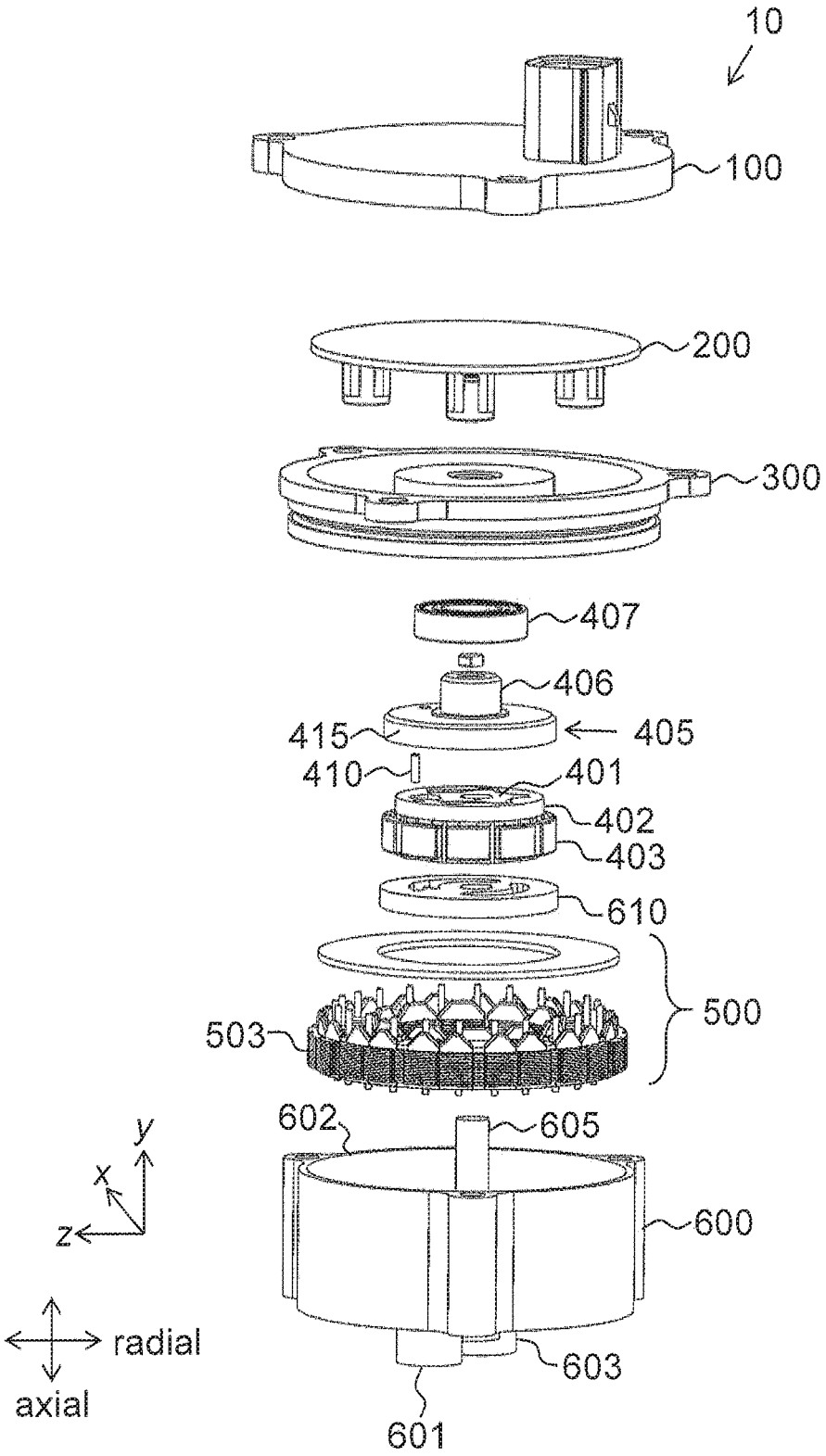
FIG. 3A is another exploded view of the gerotor pump illustrating components of the gerotor pump in a first orientation in accordance with an embodiment of this disclosure.
Figure 3B:
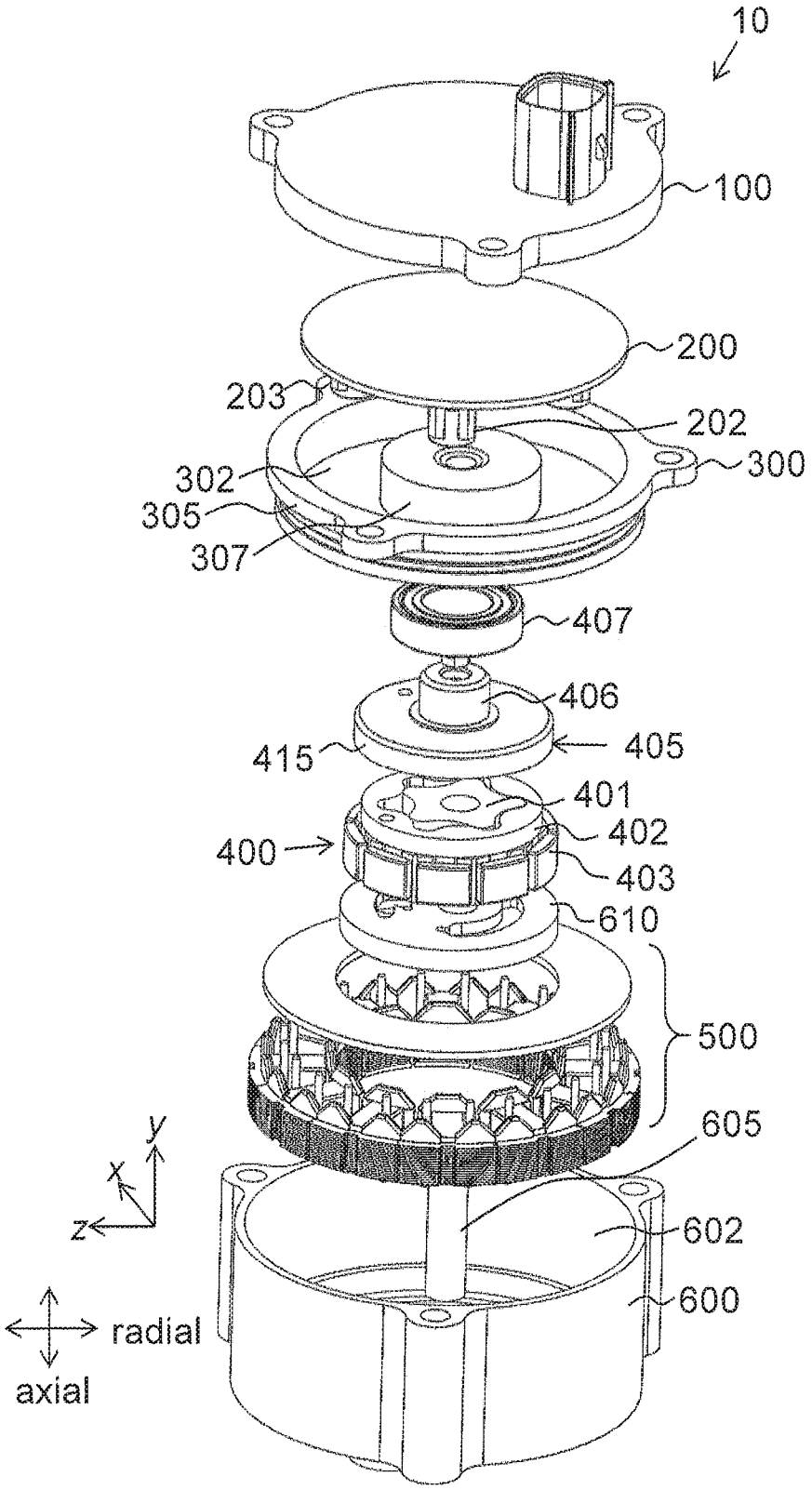
FIG. 3B is another exploded view of the gerotor pump illustrating the components of the gerotor pump in a second orientation in accordance with an embodiment of this disclosure.

FIGS. 3A and 3B are different exploded views of the gerotor pump 10 illustrating components of the gerotor pump in a first orientation and a second orientation, respectively. The gerotor pump 10 includes the top cover 100, the PCB 200, an intermediate cover or separator 300, the set of gerotor gears 400 (including an inner gear 401 and an outer gear 402), a spindle 405, a bearing 407, a pin 410, a motor stator 500, and the bottom casing 600. Alternatively or in addition, a pressure plate 610 included, for example, in the bottom casing 600 of the housing 150 to compensate for axial tolerances of the gerotor pump unit. The components of the gerotor pump 10 may be coupled together to form a compact assembly within the housing.

Figure 8A:
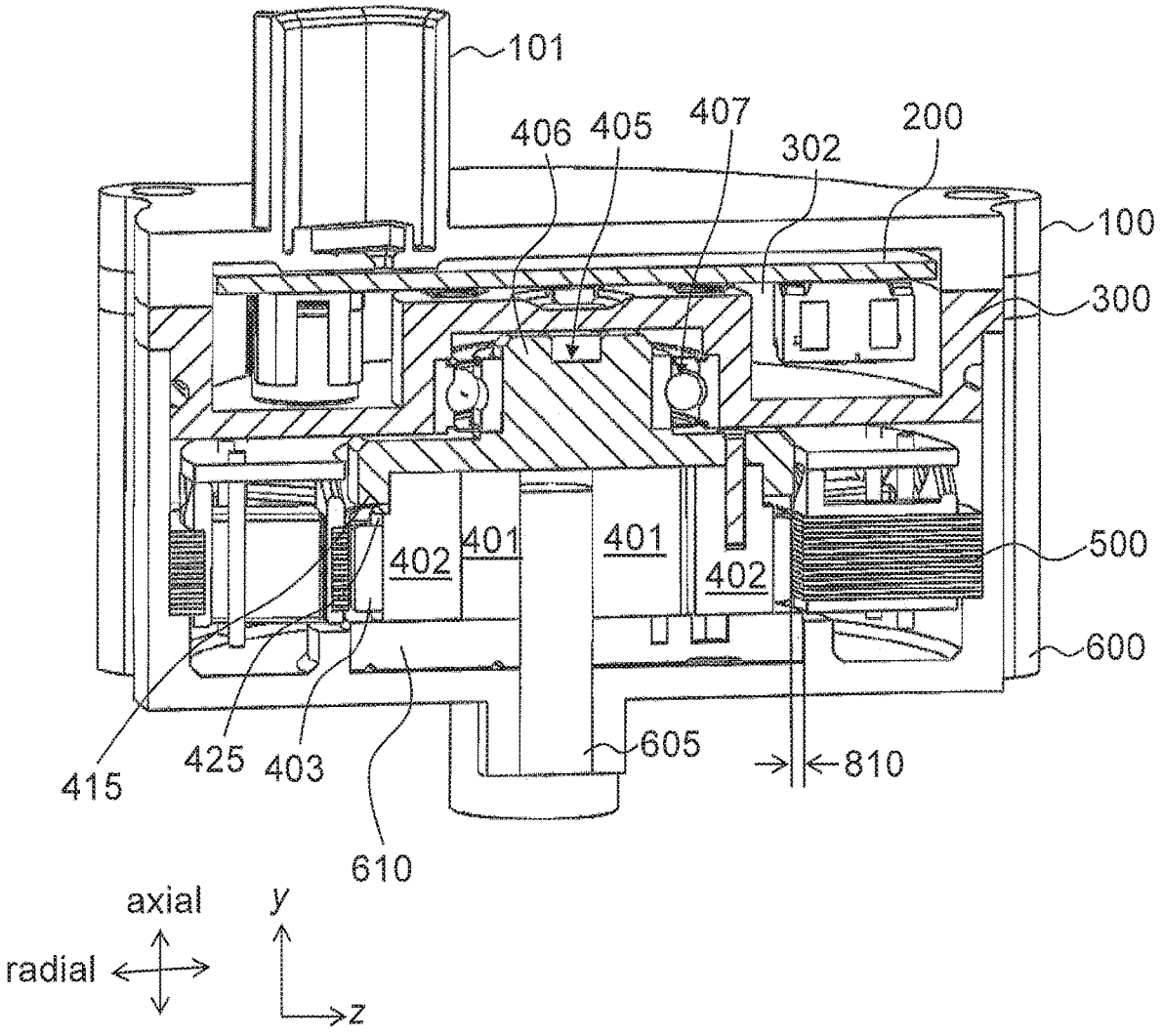
FIG. 8A is a first cross-section view of the gerotor pump in accordance with an embodiment of this disclosure.

In an embodiment, the intermediate separator 300 may support the PCB/controller 200 on a first side (i.e., between the top cover 100 and a top side of the separator 300; see, e.g., FIG. 8A) and may cover and enclose the gerotor gears 400 (401 and 402) and the motor stator 500 under the second side (i.e., between the bottom casing 600 and a bottom side of the separator 300; e.g., such as shown in FIG. 8A). In an embodiment, the separator 300 may be configured such that the first side does not include any fluid and the second side includes fluid, and thus the separator 300 serves as a wall preventing fluid to flow from the second side to the first side. That is, the side with the PCB/controller 200 is dry and devoid of fluid, and the side with the pump elements contains fluid. Hence, the separator 300 may have a dual functionality of supporting the components on either side, and also serving as a fluid obstruction or a partition.

Figure 9:
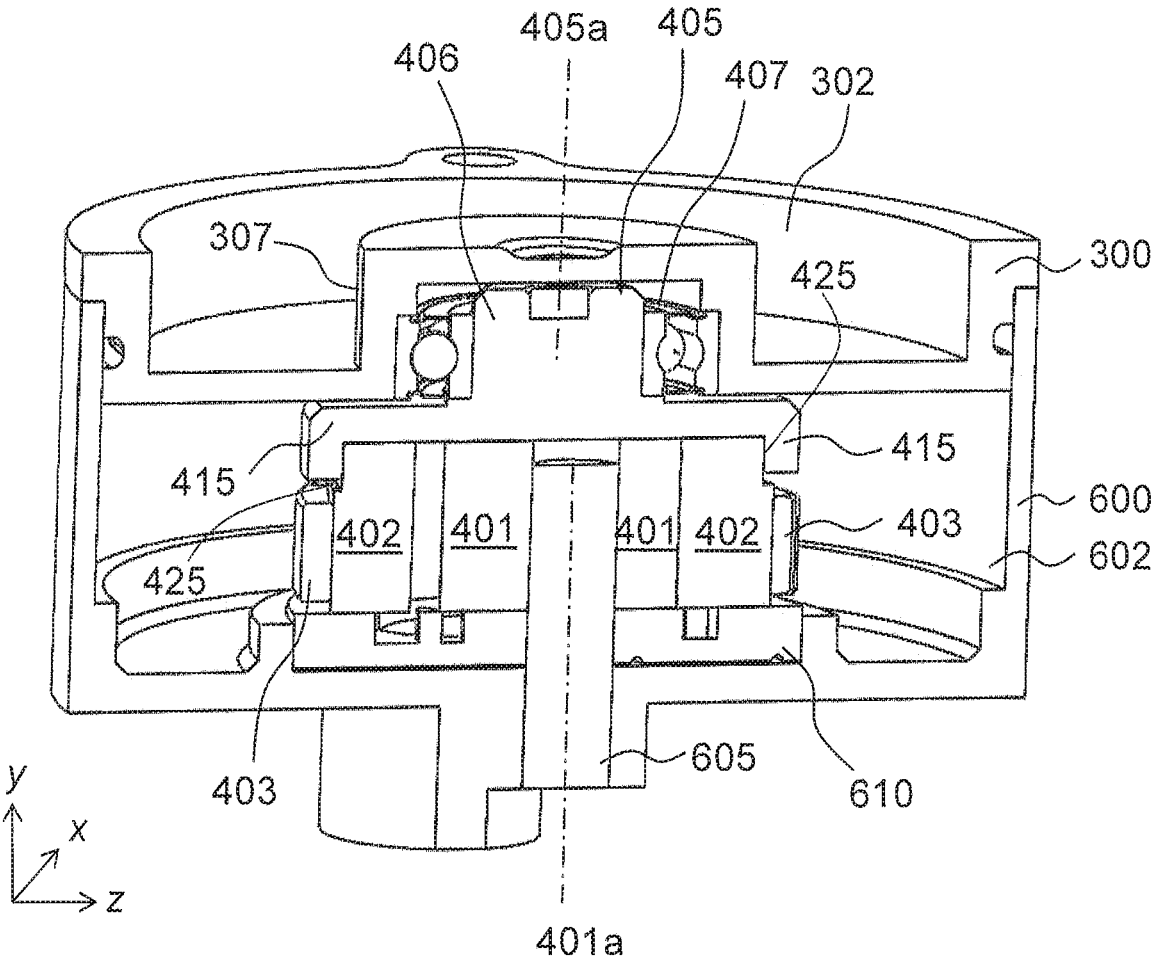
FIG. 9 is a third cross-section view of the gerotor pump with a sub-set of components of the gerotor pump in accordance with an embodiment of this disclosure.

On the first side (e.g., top side) of the separator 300, the PCB 200 may be supported or coupled to the separator 300 in a removable manner, according to an embodiment. Referring to FIGS. 3B and 8A, the separator 300 includes an annular pocket 302, a flange 305, and a bearing support 307 on its first side. The bearing support 307 may be a hollow shaft-like portion located at a center of the separator 300. When viewed from a top side of the separator 300, the shaft-like portion projects upwards towards the first side (i.e., towards the top cover 100) along the axial direction, and when viewed from a bottom side of the separator 300 (see FIGS. 8A and 9), the hollow portion may be formed and accessible from a bottom side. The hollow portion of the bearing support 307 may be configured to support or receive a bearing 407 (further discussed below with respect to the second side of the separator 300).

Around the shaft-like portion, the annular pocket 302 may be formed to accommodate the PCB 200 and its components (e.g., the electrical components 201,202, 203, 204, etc.), thus forming a compact sub-assembly on the first side of the separator 300. Furthermore, upon assembly of the gerotor pump 10 and during its operation, the separator 300 prevents the PCB 200 from contacting the fluid on its opposite side where the pump elements are located. Preferably, electrical components include capacitors, resistors, and other heat generating elements that are in direct contact with the separator 300, and the separator 300 is made of thermally conductive material. This enables the heat to be transferred to the fluid on the other side via conduction (i.e., it is transferred through the wall of the separator 300), thus effectively cooling the controller 200 and its components.

The flange 305 may be formed around the perimeter of the intermediate separator 300 and may be used to connect to the top cover 100 on one side and the bottom casing 600 on the second side. The shape of the flange 305 may correspond to a shape, for example, at the perimeter, of the top cover 100 and the bottom casing 600 to form a seamless assembly of the gerotor pump 10. In the exemplary illustrated embodiment, with the exception of protrusions that are provided in each of the top cover 100, separator 300, and bottom casing 600, the edges of the top cover 100, separator 300, and bottom casing 600 may be substantially rounded and/or substantially circular (between the protrusions). While this configuration is not intended to be limiting, it should be understood that the shapes of the perimeters/outer surfaces of the flange 305/separator 300, top cover 100, and bottom casing 600 may correspond to each other, such that these parts may be aligned and joined to form the housing 150. Furthermore, in an embodiment, the protrusions are provided in each of the top cover 100, separator 300, and bottom casing 600 such that these parts may be aligned for securement together. In one embodiment, the protrusions provided in each of these parts include receiving openings that are designed to be aligned (see, e.g., FIGS. 1B and 8A) with each other such that the top cover 100, separator 300, and bottom casing 600 may be stacked together and the aligned receiving openings may receive fasteners (e.g., bolts) (not shown) therein, in order to secure these housing parts of the pump together to form the housing assembly 150.

On the second side (e.g., bottom side) of the separator 300 may be the hollow shaft-like portion which may be provided to accommodate the bearing 407, such as shown in FIG. 8A. In an embodiment, the bearing 407 may be a ball bearing, a journal bearing or other type of bearing(s). According to the bearing type, the hollow portion of the bearing support 307 may be configured to axially fit the bearing 407. The bearing 407 may be positioned between the spindle 405 and the separator 300 (or, more specifically, between the spindle 405 and the hollow shaft-like portion of the separator 300). Furthermore, a spindle shaft 406 of the spindle 405 may axially pass into the bearing 407, and, in one embodiment, the spindle shaft 406 may further extend beyond the bearing 407 to touch or contact the bearing support 307. As such, during operation, the spindle 405 may rotate relative to the bearing 407 and the intermediate separator 300, while the separator 300 is stationary. Also, such arrangement of the spindle 405 within the bearing 407 enables the spindle 405 to be mounted rotatably/for rotation within the housing without the need for extra radial clearance in that region. Typically, in prior art solutions, there is need for, or there tends to be, extra radial clearance for movement of these parts, and this contributes to either a reduced ability to maintain a tight motor air gap between the fixed stator coils of stator 500 and rotor coils 403 provided on the gerotor outer gear 402 (described below), or misalignment during the operation or at the assembly of the gerotor pump 10, or both. This disclosed design, however, does not need or leave any extra radial clearance in the spindle 405/bearing 407 region. Instead, a radial position of the magnetic rotor may be fixed (i.e., with a tight motor air gap, or a radial gap 810), or substantially fixed, thereby substantially eliminating or eliminating any influence of the eccentricity of the motor performance. Thus, via the spindle 405, a radial gap 810 (see FIG. 8A) between the rotor coils 403, gerotor gears 400, and the motor stator 500 may be maintained with tight tolerance during operation of the pump. This provides, among other things, stable magnetic flux gap and improves noise and vibration performance of the gerotor pump 10. In addition, such configuration of the intermediate separator 300 provides for a compact assembly of the gerotor pump 10. For example, upon assembly of the components of the gerotor pump 10 on the second side of the intermediate separator 300, a chamber 602 (see FIG. 9) may be formed between the intermediate separator 300 and the bottom casing 600. The chamber 602 may be configured to accommodate the gerotor gears 400 and the motor stator 500 to form a compact assembly.

Figure 4:
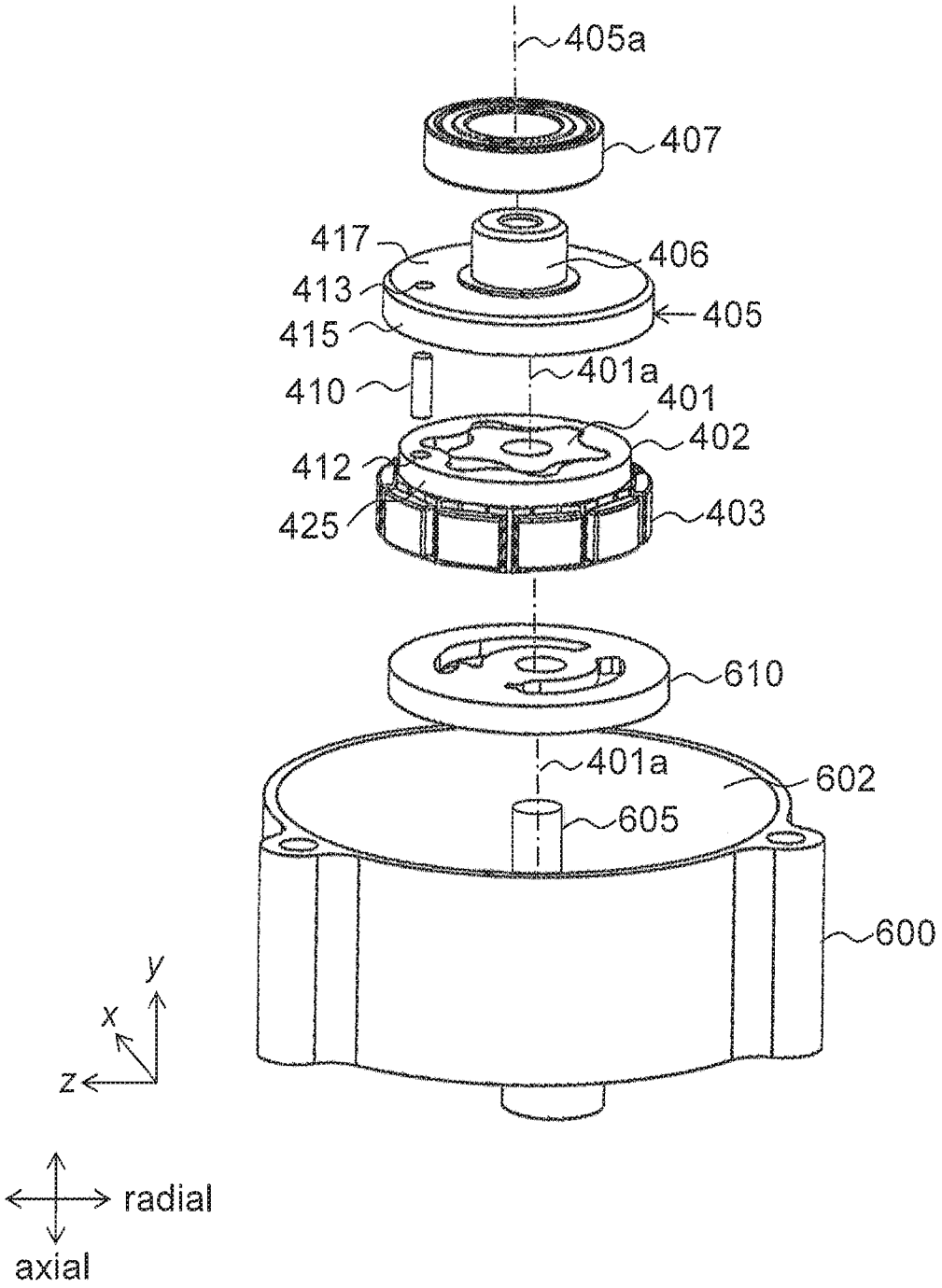
FIG. 4 is another exploded view of the gerotor pump illustrating a subset of components of the gerotor pump in accordance with an embodiment of this disclosure.
Figure 5:
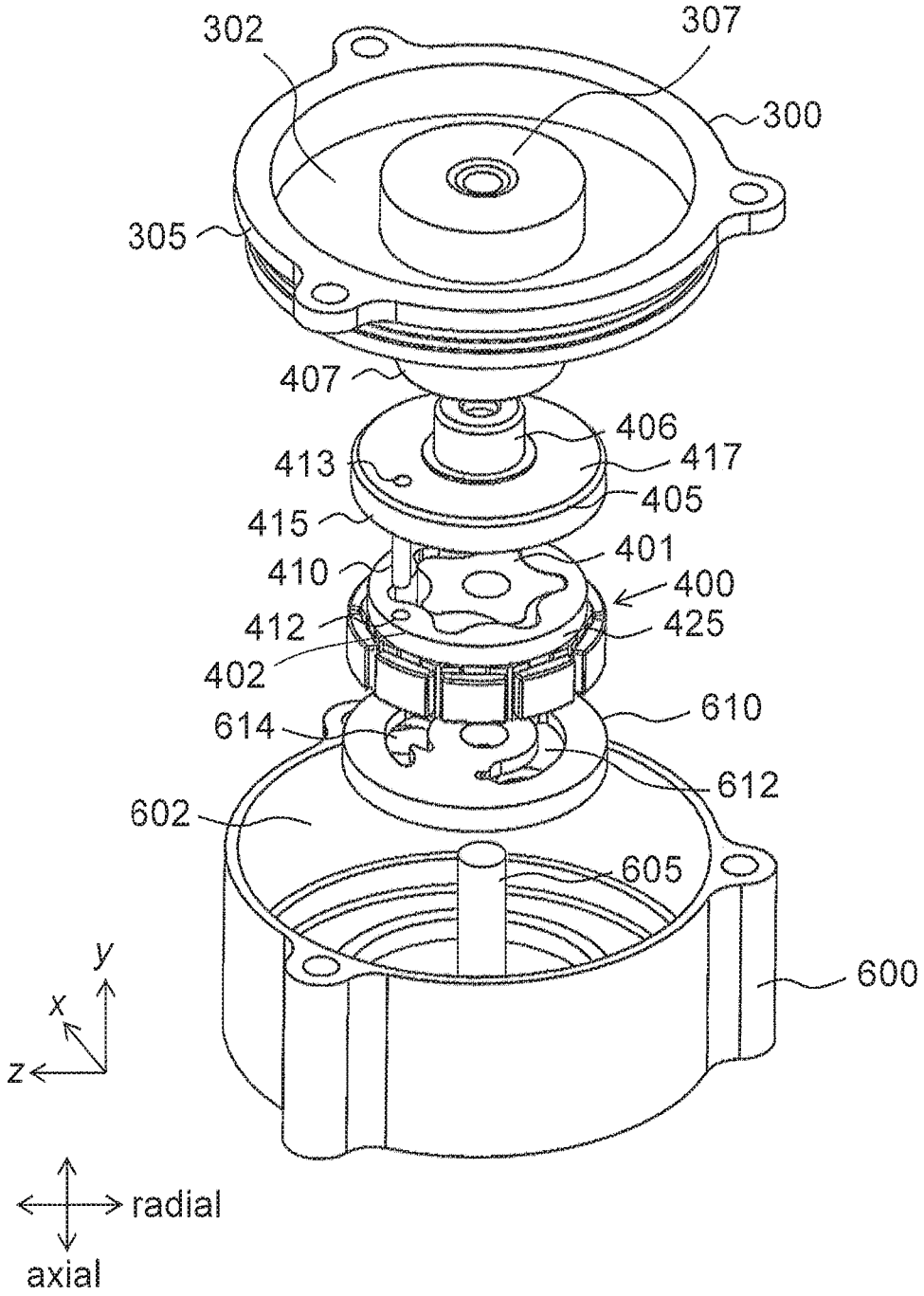
FIG. 5 is another exploded view of the gerotor pump illustrating another subset of components of the gerotor pump in accordance with an embodiment of this disclosure.
Figure 6:
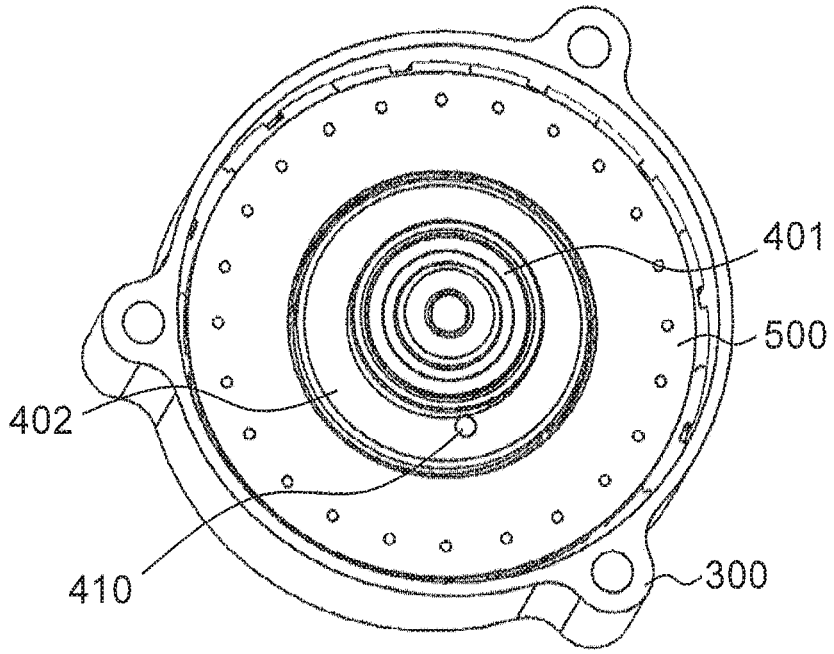
FIG. 6 is a bottom perspective view of a sub-assembly of gerotor pump components including an intermediate cover or separator in accordance with an embodiment of this disclosure.
Figure 7:
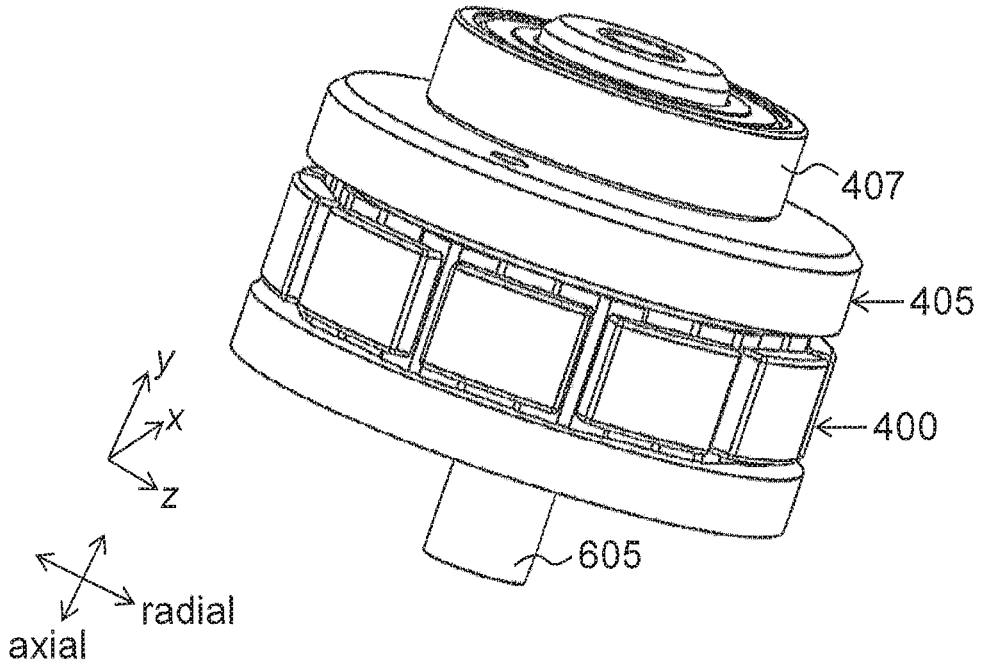
FIG. 7 is a side perspective view of another sub-assembly of gerotor pump components including a spindle in accordance with an embodiment of this disclosure.
Figure 8B:
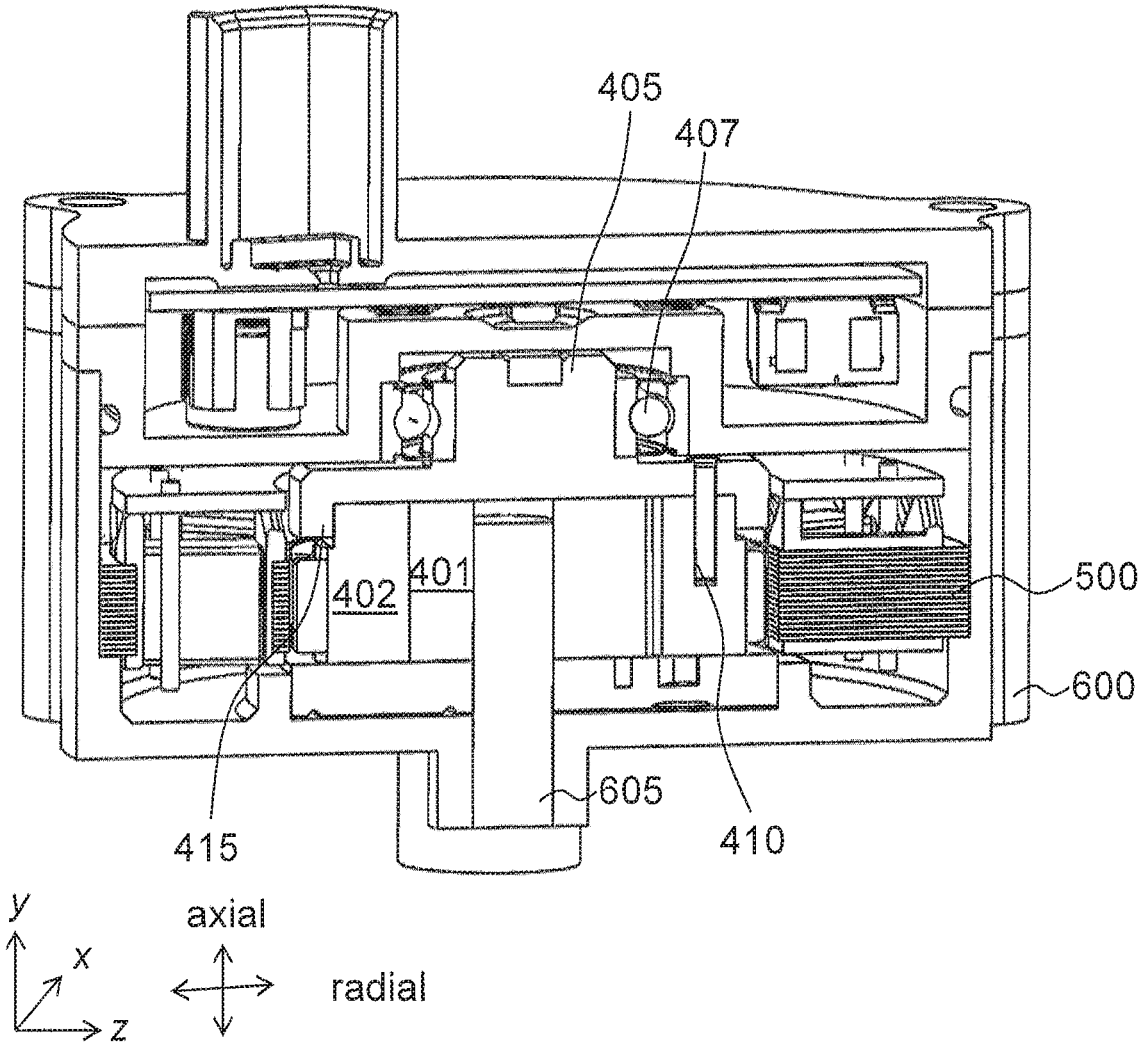
FIG. 8B is a second cross-section view of the gerotor pump in accordance with an embodiment of this disclosure.

The spindle 405 may be any component configured to hold the set of gerotor gears 400 such that the radial movement of the gerotor gears 400 may be controlled or maintained with respect to the motor stator 500. In an embodiment, the spindle 405 may be a unitary construction of the spindle shaft 406, a flange portion 415, a top surface 417 (see FIG. 4), and a through hole 412 (see FIG. 4) in the top surface 417. In an embodiment, the spindle 405 may be substantially circular or rounded with the spindle shaft 406 at the center of top surface 417 and axially projecting upwards or towards a first side (i.e., where the top cover 100 is located) from the top surface 417. The flange portion 415 may be formed at the perimeter of the top surface 417 and projecting downwards or towards a second side (i.e., where the bottom casing 600 is located). The flange portion 415 may be configured to grip a portion of an outer surface 425 of the outer gear 402 of the gerotor gears 400. Furthermore, the spindle 405 may be fixedly coupled to the outer gear 402 via the pin 410 passed through the holes 412 and 413 (when spindle 405 and set of gears are stacked together; e.g., see FIG. 8B). The holes 412 and 413 are axially aligned with each other to allow the pin 410 to pass through the holes, as shown in FIG. 8B, thus preventing a relative rotation between the spindle 405 and the outer gear 402 of the gerotor gears 400. In an embodiment, the holes 412 and 413 may be offset or formed away from an axis of rotation (axis 405*a*) of the spindle 405; e.g., the holes 412 and 413 may be formed between the perimeters of the flange portion 415 and the outer gear 402 (e.g., outer surface 425) and the spindle shaft 406. For example, the hole 413 may be formed approximately midway between the spindle shaft 406 and the flange 415. Similarly, hole 412 may be formed at a corresponding distance to hole 413 in through the body of the outer gear 402. In an embodiment, the hole 412 may be located offset from the axis of rotation 405*a* and between the outer surface 425 and internal teeth of the outer gear 402. The present disclosure is not limited by a dimension, number of holes, or location of the hole 413 (and corresponding hole 412 of the outer gear 402). In an embodiment, the diameter of the holes 412 and 413 may be less than or substantially equal to the pin 410 to limit (or prevent) an interplay between the pin 410 and the holes 412 and 413.

Thus, the spindle 405 may be fixed (e.g., via pin 410) to the outer gear 402 and configured to rotate together about a first axis 405*a* within the bearing 407. According to an embodiment, the spindle 405 and the outer gear 402 (as-is conventionally known of gerotors) may rotate about axis 405*a*, while the inner gear 401 may rotate about a second axis 401*a*. The first axis 405*a* and the second axis 401*a* are offset from each other, allowing the internal gear 401 to rotate in an eccentric manner relative to the outer gear 402.

In an embodiment, as mentioned, the set of gerotor gears 400 includes the inner gear 401 and the outer gear 402. The inner gear 401 meshes with the outer gear 402 (also illustrated in FIGS. 3B, 4, 5, 8A, 8B and 9). In an embodiment, the inner gear 401 may be coupled within an internal hollow portion of the outer gear 402 in an offset manner. For example, the inner gear 401 may be mounted on a shaft 605 (i.e., a drive shaft, such as shown in FIG. 8A) extending through the bottom casing 600 that rotates about axis 401*a*, which is offset from the axis of rotation 405*a* of the spindle 405 (and the outer gear 402). The offset arrangement of the gears 401 and 402 creates a varying volume space between the inner gear 401 and the outer gear 402 that enable the pumping of fluid. In an embodiment, the inner gear 401 may rotate about the axis of the shaft 605 (i.e., the second axis 401*a*) and the outer gear 402 may rotate about the spindle 405 (i.e., a first axis 405*a*). In an embodiment, the shaft 605 may be an input shaft that may be mechanically driven which may cause rotation of the inner gear 401 (i.e., the shaft 605 drives the inner gear 401), which further drives the outer gear 402, creating a pumping effect. The drive shaft 605 may be configured to be driven by a driver (not shown) such that it rotates about its axis (401*a*) to drive the gerotor pump 10. Such a driver may include a drive pulley, drive shaft, engine crank, gear, or electric motor, for example. One or more support bearings may support the drive shaft.

The inner gear 401 has external teeth (i.e., formed on an outer side of the inner gear 401, as shown in FIG. 3B, for example) which meshes with internal teeth (i.e., formed on an inner side of the outer gear 402, as shown in FIG. 3B) of the outer gear 402. As the inner gear 401 rotates/meshes with outer gear 402, crescent-like shape(s) may be formed between the teeth of the gears 401 and 402. Within these shapes, the (input) fluid is compressed or pressurized as the gears rotate. Furthermore, in one embodiment, the outer gear 402 may have greater number of teeth than the inner gear 401, thus the inner gear 401 may rotate at a slower speed compared to the outer gear 402. For example, the outer gear 402 may have six (6) internal teeth and the inner gear 401 may have five (5) external teeth. In an embodiment, the gerotor pump 10 may be a crescent internal pump, for example, having involute gear and in which the number of teeth on the inner gear differs from the outer gear by more than one. In an embodiment, the gerotor pump 10 may not include crescent-like shape(s) between the inner gear 401 and the outer gear 402 during rotation. The shapes or areas formed between the gears, that receive and pressurize the fluid during rotation, are not intended to be limiting. The type, number, and shape of teeth of the inner gear 401, outer gear 402, the gears themselves, and parts used therewith, are also not intended to be limited.

FIGS. 3A and 3B also show the (optional) pressure plate 610, which may be provided in the bottom casing 600 (see also, e.g., FIG. 8A). The inner gear 401 may be placed against the pressure plate 610 to compensate for any clearance between the inner gear 401 and the ports. In accordance with an embodiment, the drive shaft 605 may extend through the pressure plate 610 and into the housing assembly 150. Furthermore, the pressure plate 610 may include two radial slots partially extending in a radial direction and separated from each other. In an embodiment, one radial slot may provide a fluid path from the entry port 601 to the gerotor gears 400 and a second radial slot may provide a fluid path from the gerotor gears 400 to the discharge port 603.

In an embodiment, the set of gerotor gears 400 may be electromagnetically driven via the outer gear 402. The outer gear 402 may include a series of magnets that may be magnetically coupled to the motor stator 500 thus forming an electromagnetic motor configuration. In such configuration, the rotor 403 may be referred as a motor rotor and the motor stator 500 may be referred to as a stator, or vice-versa depending on a relative rotation of the gears 400 and the motor stator 500. The rotor 403 may be disposed on an outer surface of the outer gear 402, as shown. In an embodiment, a rotor (i.e., the outer gear 402) may be four-pole-rotor, a six-pole-rotor, an eight-pole-rotor, etc. which corresponds to similar number of poles on the stator (i.e., the motor stator 500). For example, the rotor coils 403 may be configured to form at least two magnetic poles (a north pole and a south pole), where a first pole may be diametrically opposite to the second pole. In an embodiment, the rotor 403 may be permanent magnets having poles corresponding to the motor stator 500. In an embodiment, the motor configuration may correspond to any other type of motors such as a reluctance motor. For example, a reluctance motor configuration where non-permanent magnetic poles on the ferromagnetic rotor may be formed on the outer gear 402.

In an embodiment, the outer gear 402 may be disposed internal to the motor stator 500 with the radial gap 810 (illustrated in FIGS. 8A and 8B) in a radial direction, therebetween. In FIGS. 8A and 8B, the radial gap 810 may be formed between magnets and the poles of the motor stator 500. The radial gap 810 is desired to be small (e.g., less than approximately 0.5 mm) and must be maintained or substantially maintained such that its size/dimension is approximately and relatively consistent during operation of the pump, in order to maintain a relatively high amount of magnetic flux between the motor stator 500 and the outer gear 402, with minimal variation, for smooth and efficient operation of the gerotor pump 10. For example, a tolerance or variance of ±2% of a selected gap or a desired gap (810) may be maintained in the disclosed pump. If the gap 810 increases, the magnetic flux may drop exponentially, thus reducing the efficiency of the gerotor pump 10. According to an embodiment, such radial gap 810 may be tightly maintained or controlled due to the coupling between the outer gear 402 and the spindle 405. For example, as discussed earlier and as shown in FIGS. 3A, 3B, 4, 5, 8A, 8B, and 9) the outer gear 402 may be fixedly coupled to the spindle 405 via the pin 410, in accordance with an embodiment. More than one pin may be used in an alternate embodiment.

The motor stator 500 is mounted in the casing 600 and designed for rotation relative to the gerotor gears 400. The motor stator 500 may be coupled to PCB 200, which may be configured to activate the motor stator 500 causing the outer gear 402 to rotate. In an embodiment, the motor stator 500 may be manufactured as an overmolded stator that is supported or mounted in the casing 600, a stator having a core with winding placed in the casing 600, or another type of stator placed therein. An overmolded motor stator 500 may include a lamination stack held together via an overmolded resin, for example. The overmolded motor stator 500 may also help reduce vibrations during the operation of the gerotor.

According to an embodiment, in operation, the motor stator 500 when activated causes the outer gear 402 (and the spindle 405) to rotate about the axis 405*a*. The rotation of the outer gear 402 further rotates the inner gear 401 about the axis 401*a* in an eccentric manner. Further, the crescent-like shape(s) between the gears 401 and 402 causes a suction when the gear teeth disengage, for example, at the suction end 601 of the housing, and a compression when the gear teeth engage at a discharge end 603 of the housing.

In an embodiment, one or more components of the gerotor may be manufactured from powdered material to limit frictional losses during the operation of the gerotor, thus increasing the efficiency of the gerotor.

The gerotor pump 10 according to the present disclosure has several non-limiting advantages, some of which have been noted previously. For example, a gap (e.g., radial gap 810) may be maintained approximately consistent during assembly and operation of the gerotor pump, thus providing a relatively consistent flux throughout the radial gap 810 thereby increasing operational efficiency and operating speed. According to an embodiment, by using the spindle 405 and the bearing 407 without extra radial clearances (and/or by limiting their radial clearance and/or movement, while still effectively maintaining the gap 810), the less-sensitive issue of radial clearance between the gear teeth tips can be managed by tolerances between the inner gear bore and the shaft 605 received in it. Furthermore, the spindle 405 and bearing 407 arrangement may reduce vibrations, for example, between the outer gear 402 and the inner gear 401, thereby maintaining a tight gap between the motor stator 500 and the electric coils of the outer gear 402. Also, reduced vibration enables maintaining a consistent gap 810, allowing the gerotor gears 400 to be rotated at increased speed. The spindle 405 enables self-alignment during assembly and when the gerotor is operating. The spindle 405 (with the bearing 407) and the pin 410 connection with the gear set reduces the requirement of a high precise gear tip tolerances (e.g., between the engaging gear teeth) between the inner gear 401 and the outer gear 402.

Furthermore, the complexity of field orientation control (FOC) may be reduced (e.g., due to reduced vibration), thus allowing driving the pump at high speeds.

Using the pressure plate 610 in combination with the spindle 405 also allows for compensation with regards to tolerances of the pump unit, and overcome issues with regards to integration. The frictional impact between rotating parts is dramatically reduced with the used of, for example, bearing 407 compared to use of bushings.

Active cooling of the controller may be implemented via the construction of the separator 300 and fluid in the housing assembly, thereby enabling better thermal measurement and control for the controller (e.g., PCB 200). Also, use of a PCB bus bar to replaces a conventional bus bar, in accordance with an embodiment, may further reduce the cost associated with the pump.

An overmolded motor stator 500 may be used to overcome seal issues. In accordance with an embodiment, the stator may be formed using a powder metal. Furthermore, in an embodiment, an overmolded rotor may be formed, e.g., by a powder metal. In an embodiment, both the stator and rotor may be overmolded. In one embodiment, a sheet mounting compound (or composite) process (SMC) may be utilized, e.g., to manufacture the outer gear 402 with the rotor coil 403, thereby reducing the cost of manufacturing, as well as to eliminate laminations from the stator.

Furthermore, the gerotor pump 10 has improved overall motor (or pump) efficiency based on consistent air gap and corresponding magnetic flux, and improved pump's mechanical efficiency based on reduced friction between rotating parts. In accordance with an embodiment, up to fifty (50) percent (%) of existing friction between parts may be eliminated in the disclosed design as compared to prior art solutions. Furthermore, motor integration may be established, in accordance with an embodiment, by using sheet molding compound (SMC) material for outer rotor (e.g., rotor coils 403) and magnets, in accordance with an embodiment. The electric oil pump assembly process may be more robust. An intermediate ring may be used to improve hydrodynamic lubrication between the spindle and bearing.

As previously noted, the gerotor pump 10 may be associated with a system in accordance with an embodiment of the present disclosure. The system may be a vehicle or part of a vehicle, for example. Such a system may include a mechanical system such as an engine (e.g., internal combustion engine) and/or a transmission of an automotive vehicle for receiving pressurized lubricant from the pump 10. The pump 10 receives (input via pump inlet) fluid/lubricant (e.g., oil) from a lubricant source and pressurizes and delivers it to the engine or transmission (output via outlet). A sump or tank may be the lubricant source that inlets to the pump 10. The controller in the pump 10 may be designed for implementing actuation of the system and/or pump 10.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A gerotor pump comprising:

an inlet for receiving fluid from a source;

an outlet for delivering pressurized fluid to a system therefrom;

an inner gear mounted on a first axis for rotation;

an outer gear mounted relative to a second axis and meshing internally with the inner gear in an offset manner;

a drive shaft coupled to the internal gear, the drive shaft being configured to be driven by a driver, to mechanically drive the internal gear about the first axis in order to pressurize the received fluid for output as the pressurized fluid;

an electrical motor including a rotor and a stator having a radial gap therebetween in a radial direction, the rotor being disposed on an outer surface of the outer gear, and the electrical motor configured to electromagnetically drive the outer gear to rotate and thus further rotate the inner gear about the first axis in an eccentric manner; and a spindle fixedly coupled to the outer gear to facilitate substantially maintaining the radial gap between the rotor and the stator in the radial direction, and configured for rotation about the second axis.

2. The gerotor pump according to claim 1, wherein the inner gear, the outer gear, the electrical motor, and the spindle are contained within a housing.

3. The gerotor pump according to claim 2, further comprising a pressure plate positioned below the inner and outer gears within the housing.

4. The gerotor pump according to claim 3, wherein the drive shaft extends through the pressure plate and into the housing.

5. The gerotor pump according to claim 2, wherein the housing comprises a controller and an intermediate separator provided therein, wherein the inner gear, the outer gear, the electrical motor, and the spindle are positioned below the intermediate separator and wherein the controller is positioned above the intermediate separator.

6. The gerotor pump according to claim 5, wherein a bearing is provided between the spindle and the intermediate separator, wherein the intermediate separator comprises an annular pocket and a bearing support portion, wherein the annular pocket is provided on a first side of the intermediate separator and wherein the bearing support portion is provided on a second side of the intermediate separator and configured to receive the bearing therein.

7. The gerotor pump according to claim 6, wherein the annular pocket is configured to receive the controller.

8. The gerotor pump according to claim 5, wherein the inner gear, the outer gear, the electrical motor, and the spindle are in contact with a fluid contained below the intermediate separator and the housing.

9. The gerotor pump according to claim 1, wherein the spindle is fixedly coupled to the outer gear via a pin.

10. The gerotor pump according to claim 1, wherein the spindle further comprises a flange portion, and wherein the flange portion is configured to grip a portion of the outer gear.

11. The gerotor pump according to claim 1, wherein the system is a transmission or an engine.

12. A system comprising:

an engine or a transmission, and a gerotor pump, the gerotor pump comprising:

an inlet for receiving fluid from a source;

an outlet for delivering pressurized fluid to the engine or the transmission;

an inner gear mounted on a first axis;

an outer gear mounted on a second axis that is offset from the first axis such that the outer gear meshes internally with the inner gear in an offset manner;

a drive shaft coupled to the internal gear, the drive shaft being configured to be driven by a driver, to drive the internal gear about the first axis in order to pressurize the received fluid for output as the pressurized fluid;

an electrical motor including a rotor and a stator having a radial gap therebetween in a radial direction, the rotor being disposed on an outer surface of the outer gear, and the electrical motor configured to electromagnetically drive the outer gear to rotate and thus further rotate the inner gear about the first axis in an eccentric manner; and a spindle fixedly coupled to the outer gear to facilitate substantially maintaining the radial gap between the rotor and the stator in the radial direction, and configured for rotation about the second axis.

13. The system according to claim 12, wherein the inner gear, the outer gear, the electrical motor, and the spindle are contained within a housing.

14. The system according to claim 13, further comprising a pressure plate positioned below the inner and outer gears within the housing.

15. The system according to claim 14, wherein the drive shaft extends through the pressure plate and into the housing.

16. The system according to claim 13, wherein the housing comprises a controller and an intermediate separator provided therein, wherein the inner gear, the outer gear, the electrical motor, and the spindle are positioned below the intermediate separator and wherein the controller is positioned above the intermediate separator.

17. The system according to claim 16, wherein a bearing is provided between the spindle and the intermediate separator, wherein the intermediate separator comprises an annular pocket and a bearing support portion, wherein the annular pocket is provided on a first side of the intermediate separator and wherein the bearing support portion is provided on a second side of the intermediate separator and configured to receive the bearing therein.

18. The system according to claim 12, wherein the spindle is fixedly coupled to the outer gear via a pin.

19. The system according to claim 12, wherein the spindle further comprises a flange portion, and wherein the flange portion is configured to grip a portion of the outer gear.

* * * * *